United States Patent [19]

Yang

[11] Patent Number: 4,627,620

[45] Date of Patent: Dec. 9, 1986

[54] ELECTRONIC ATHLETE TRAINER FOR IMPROVING SKILLS IN REFLEX, SPEED AND ACCURACY

[76] Inventor: John P. Yang, 59 Royce Brook Rd., Belle Mead, N.J. 08502

[21] Appl. No.: 686,467

[22] Filed: Dec. 26, 1984

[51] Int. Cl.[4] ..... A63B 71/02; A63B 71/06

[52] U.S. Cl. ..... 273/1 GC; 273/1 GE; 273/375; 273/392; 272/76

[58] Field of Search ..... 273/1 GC, 1 GE, 374, 273/375, 390; 434/247, 251, 256, 258

[56] References Cited

U.S. PATENT DOCUMENTS 4,169,592 10/1979 Hall ..... 434/258

4,461,475 7/1984 Nakamura ..... 273/1 GC

FOREIGN PATENT DOCUMENTS 2725662 12/1978 Fed. Rep. of Germany ... 273/1 GE

*Primary Examiner*—Richard C. Pinkham

*Assistant Examiner*—Stuart W. Rose

[57] ABSTRACT

An electronic apparatus for improving skills in reflex, speed and accuracy of the player as well as for recreational purposes is disclosed in which multiple targets spread around the player are selected with random sequence by an electronic device. The selections of targets are indicated by the visual indicators as well as an audio alarm on the electronic device. When the targets are selected, a timer on the electronic device is activated and the elapsed time is indicated by a display on the electronic device. The timer is halted when the targets are hit by the player. The indicators are then disabled and the elapsed time which measures the performance of the player is indicated by the display on the electronic device. The speed of target selection preceded by fake target selections is provided to improve player's reflex.

2 Claims, 7 Drawing Figures

ELECTRONIC ATHLETE TRAINER FOR IMPROVING SKILLS IN REFLEX, SPEED AND ACCURACY

BACKGROUND OF THE INVENTION

1. Field of the Invention

The present invention relates to apparatus for training athletes in improving skills in reflex, speed and accuracy.

2. Brief Description of the Prior Art

There have been known in the prior art apparatuses which make use of mechanical and electronic devices to train athletes in improving certain skills in certain specific sports. Indicative of such apparatuses are described in the following U.S. Pat. Nos.: 4,169,592, 4,461,475, and Germany Pat. No. 2,725,662. There has been little development in training apparatus for improving athlete's skills in reflex, speed and accuracy for all sports. It is, therefore, an object of this invention to provide a new training apparatus for athletes in improving skills in reflex, speed and accuracy for all sports. It is another object of this invention to provide a training apparatus for athletes having electronic devices which may be easily and economically made for all athletes. It is an additional object of this invention to provide a training apparatus for athletes providing electrically and electronically enhanced responses to the action of the players. It is still a further object of this invention to provide a simple apparatus for people of all ages to enjoy exercise with amusement either indoor or outdoor.

SUMMARY OF THE INVENTION

The foregoing and other objects of the invention are accomplished by an apparatus which has an electronic device that can select targets with random sequence and display the elapsed time with a visual display. The audio alarm is provided to alert the player on target selection.

The apparatus includes means for programming different speeds on target selection and may also include means for making true and fake target selections.

The apparatus also has multiple targets. Each target includes indicating means to indicate the selection of the target and mechanical and electrical means to reset the target selection. Electrical means is provided to make communications between targets and electronic device.

Other objects, features, and advantages of the invention will become apparent from a reading of the specification taken in conjunction with the drawings in which like reference numerals refer to like elements in the several views.

DESCRIPTION OF THE PREFERRED EMBODIMENT

Figure 1:
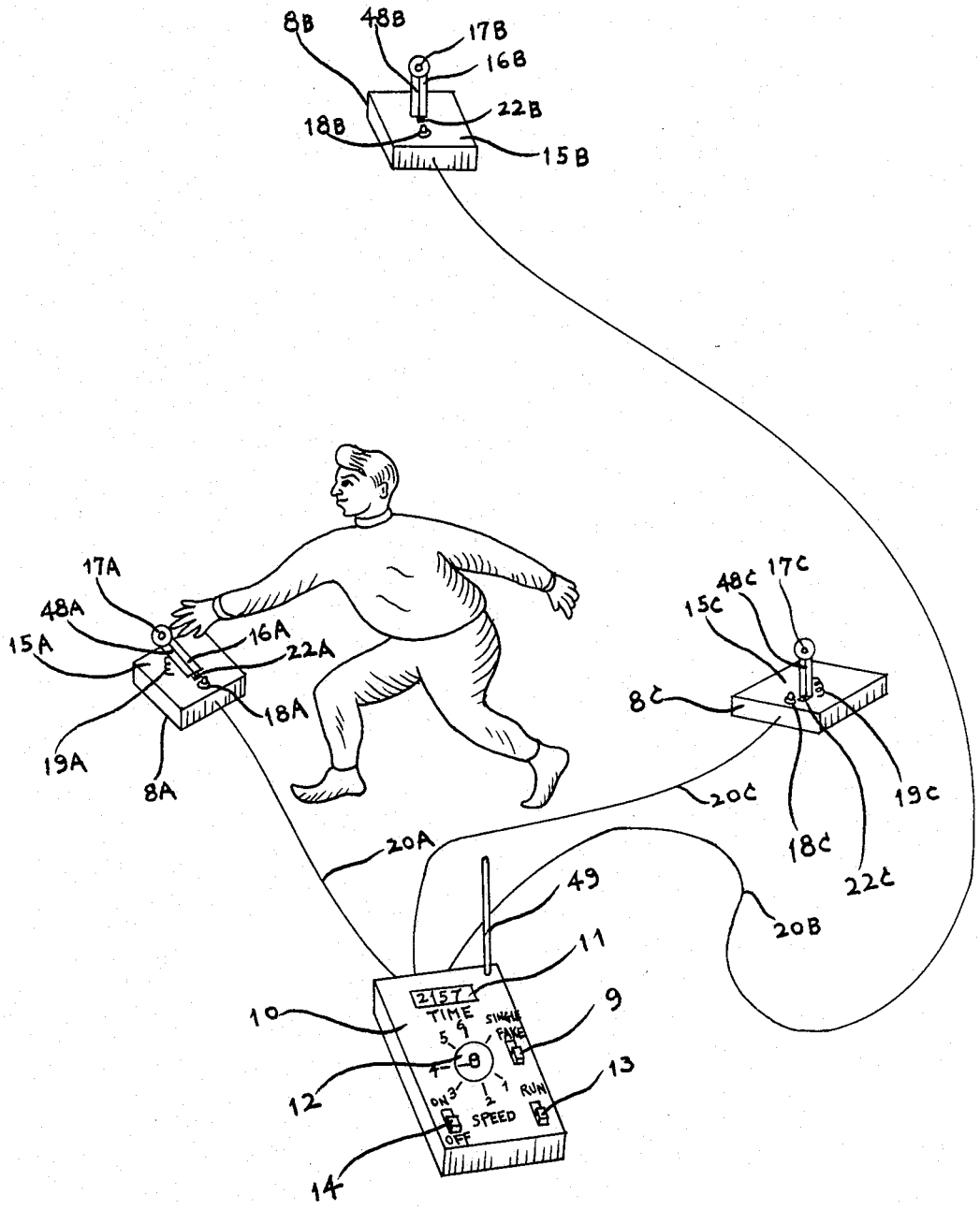
FIG. 1 is a perspective view of a training apparatus constructed in accordance with the invention.
Figure 2:
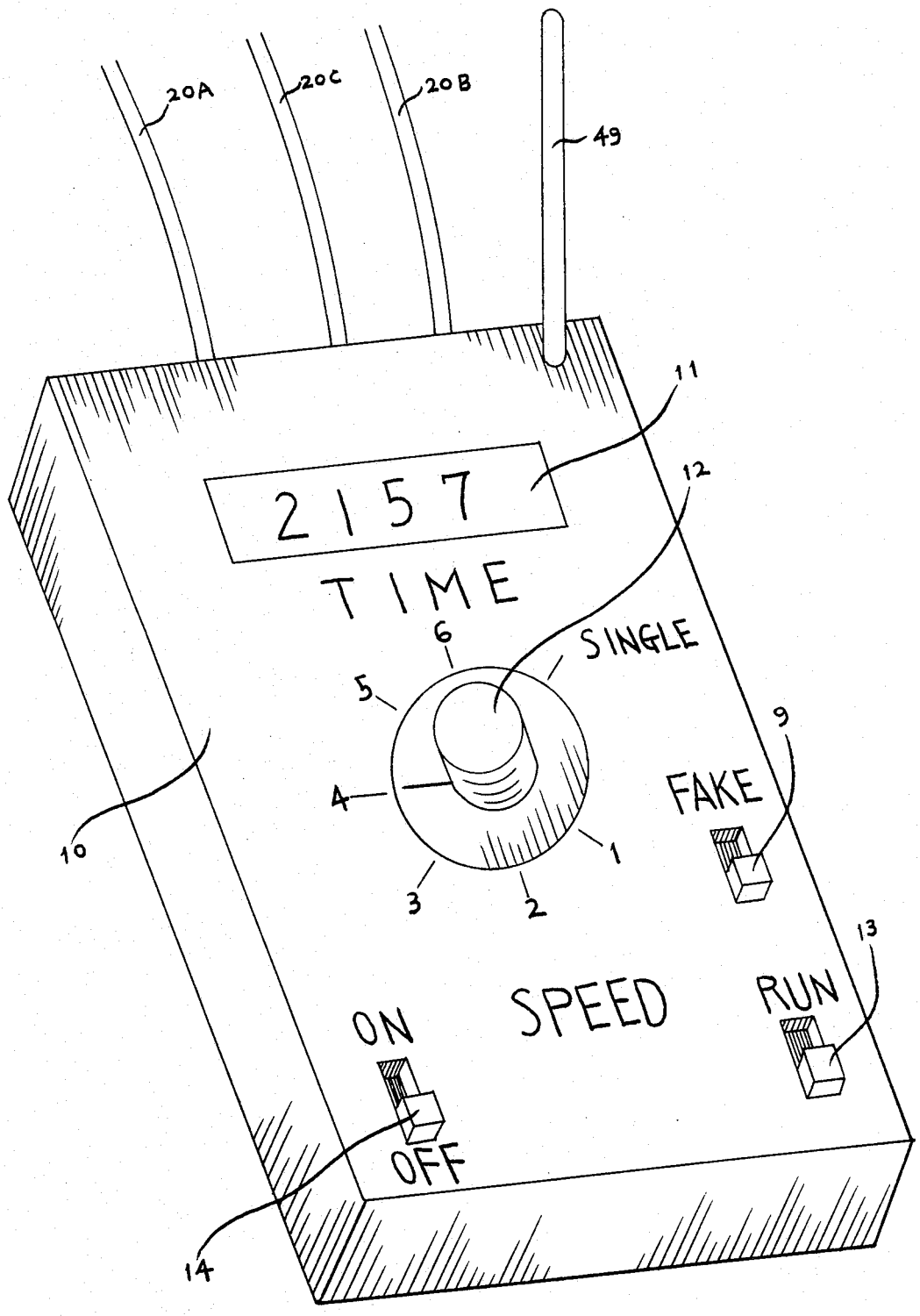
FIG. 2 is a perspective view of an electronic device which may be used with the training apparatus shown in FIG. 1.

Referring now to FIG. 1, there is shown a training apparatus constructed in accordance with the invention. The electronic device 10 includes a time display 11, a speed selection switch 12, a RUN switch 13, a power ON-OFF switch 14, a FAKE switch 9 and electronic control elements. The enlarged view of the electronic device 10 is shown in FIG. 2. The electronic control elements are concealed inside the package box of electronic device 10 and will be discussed in details in later section. The power ON-OFF switch 14 controls the battery power source of the electronic device 10. When the switch 14 is in ON position, battery power is applied to the electronic device 10. When it is in OFF position, battery power is removed from the electronic device 10. The RUN switch 13 controls the operating sequence of the training apparatus. When the switch 13 is switched from OFF to RUN position, the electronic control elements inside the package box of electronic device 10 are enabled. The electronic control elements first clear the time display 11 and then initiate the target selection to select the targets 8A, 8B and 8C in random sequence. The target selection signals are generated by the electronic control elements inside the electronic device 10 and transmitted from the electronic device 10 to the targets 8A, 8B and 8C through signal cables 20A, 20B and 20C respectively. When the target 8A receives the selection signal, the light emitting diode 18A is turned on to indicate the selection of target 8A. Targets 8B and 8C are operated in the same manner as that of target 8A. The audio alarm 41 inside the electronic device 10 is activated when any of the targets 8A, 8B and 8C is selected by the electronic control elements inside the electronic device 10 to indicate the selection of target. The selected targets stay in selected condition until reset signals from the selected targets are received by the electronic control elements inside the electronic device 10. The reset signal from target 8A is generated when the target ring 17A is hit by the player. The reset signal is transmitted from the target 8A to the electronic device 10 through signal cable 20A. Reset signals from targets 8B and 8C are generated and transmitted in the same manner as that of target 8A and details of reset signal generation will be discussed in later section. The timer 46, a decade counter inside the electronic control elements of electronic device 10, is activated when the first target is selected and stayed in active condition until all the selected targets are reset by the player. The elaped time which measures the performance of the player is indicated by the time display 11. The speed selection switch 12 can be a rotary switch with multiple positions. It controls the speed of target selection to accommodate different skills of different players.

The FAKE switch 9 controls the FAKE operation. When it is switched from OFF to FAKE position, normal target selection sequence is suppressed and fake target selection signals are generated before the true target selection to improve player's reflex. Details of FAKE operation will be discussed in later section.

Using signal cables 20A, 20B and 20C to communicate between electronic device 10 and targets 8A, 8B and 8C is simple and economical. But an optional feature is available to use radio signals to perform the same function. A transmitter and receiver 50 inside the electronic device 10 and an antenna 49 at the corner of the electronic device 10 can replace the signal cables 20A, 20B and 20C to perform the same function.

Figure 3:
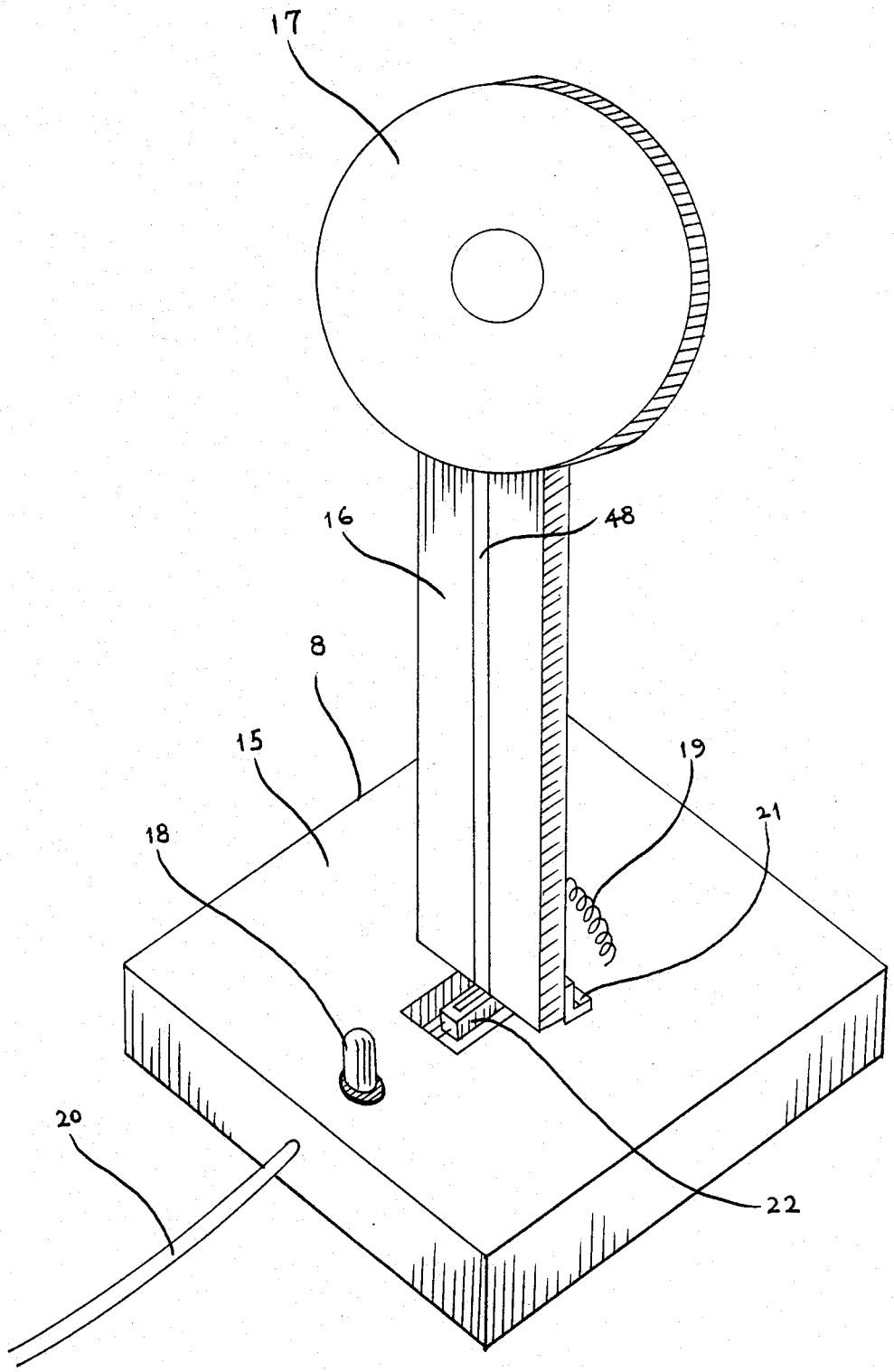
FIG. 3 is a perspective view of a target which may be used with the training apparatus shown in FIG. 1.

Referring now to FIG. 3, there is shown a target 8 that includes a target base 15, a supporting arm 16, a target ring 17, a light emitting diode 18, a spring 19, a signal cable 20 (or an optional antenna 48 and optional transmitter/receiver 47), a hinge 21 and a reset switch 22. The target base 15 houses the light emitting diode 18 and the reset switch 22 (and optional transmitter/-receiver 47) and holds the supporting arm 16 and target ring 17 in stable position. The supporting arm 16 elevates the target ring 17 to the right height for the player and controls the open and close conditions of the reset switch 22. The target ring 17 is the visual target for the player to hit on. The light emitting diode 18 indicates the selection of the target 8. The spring 19 absorbs the impact energy when the target ring 17 is hit by the player and restores the supporting arm 16 to its initial position after the impact. The signal cable 20 transmits the selection and reset signals between the electronic device 10 and the target 8. The same function can be performed by optional antenna 48 and transmitter/-receiver 47. The hinge 21 supports the rotation movement of the supporting arm 16. The reset switch 22 generates the reset signal to the electronic device 10 when the target ring 17 is hit by the player. Details of the construction and operation of target 8 will be discussed in later section.

The play of the training apparatus is such that the player first places the targets 8A, 8B and 8C around him within suitable distance and then turns on the POWER ON switch 14. If he chooses to play the regular sequence, he may select the speed of target selection by turning the speed selection switch 12 to one of the multiple positions and then turns on the RUN switch 13 and waits for the target selection from the electronic device 10. When the player hears the alarming sound from the audio alarm 41 which indicates the selection of the first tgarget 8, he immediately identifies the selected target 8 by finding the lit light emitting diode 18 on the selected target 8 and rushes to the selected target 8 with fastest speed and accurately hits the target ring 17 of the selected target 8 which in turn resets the selected target 8 and turns off the light emitting diode 18 on the selected target 8. After a fixed interval from the selection of the first target 8, the second target 8 is selected randomly by the electronic device 10. If the player resets the selection of the first target 8 before the selection of the second target 8, the timer 46 and the audio alarm 41 inside the electronic device 10 will be halted and the player just waits for the selection of the second target 8. If the second target 8 is selected by the electronic device 10 before the player resets the selection of the first target 8, the timer 46 and the audio alarm 41 inside the electronic device 10 will be running continuously. At the selection of the second target 8 the light emitting diode 18 on the second selected target 8 is lit and the timer 46 and the audio alarm 41 inside the electronic device 10 resume or continue running depending on the reset condition of the first selected target 8. The player identifies the second selected target 8 by finding the lit light emitting diode 18 on the second selected target 8 and rushes to the second selected target 8 with fastest speed and accurately hits the target ring 17 on the second selected target 8 which in turn resets the second selected target 8 and turns off the light emitting diode 18 on the second selected target 8. The selection and reset operations of the third target 8 are identical to that of the first and second target 8's. The first target 8 can be randomly reselected as the third target 8 after the second target selection by the electronic device 10 to prevent the player from predicting the selection of the third target 8. When all three targets are reset by the player, the timer 46 and the audio alarm 41 inside the electronic device 10 are halted and the elapsed time is displayed on time display 11.

If the player chooses to play the FAKE sequence, he first turns on the FAKE switch 9 and then selects the speed of target selection by turning the speed selection switch 12 to one of the multiple positions and turns on the RUN switch 13 and waits for the target selection from the electronic device 10. The selection of target 8 in the FAKE sequence is different from that of the regular sequence in which zero, one or two fake target 8 selections are randomly placed before the true target 8 selection. In the fake target 8 selection the light emitting diode 18 of the selected target 8 is first lit and then reset after a short interval by the electronic device 10 and the timer 46 in the electronic device 10 is always disabled. The audio alarm 41 is turned on at the selection of the first fake target 8 and continued on until the true target 8 selection is reset by the player. When the true target 8 selection is finally executed, the light emitting diode 18 on the true selected target 8 is lit and the timer 46 inside the electronic device 10 is turned on. The player rushes to the true target 8 with fastest speed and accurately hits the target ring 17 of the true target 8 which in turn resets the true target 8 and turns off the light emitting diode 18 on the true target 8 and halts the audio alarm 41 and the timer 46 inside the electronic device 10.

In order to accommodate different sports, many different ways can be used to hit the target ring 17 of the selected target 8 and reset the selection of the target 8. For basketball, volleyball, baseball and football, it can be hit with hand. For soccer, football, speedball, judo, karate and aikido, it can be kicked with foot. For fencing, it can be hit with sword. For tennis, squash, paddleball, badminton and table tennis, it can be hit with racket. For baseball, handball, softball, speedball, cricket and rounders, it can be thrown at with ball. More details are explained in FIG. 7.

Figure 4:
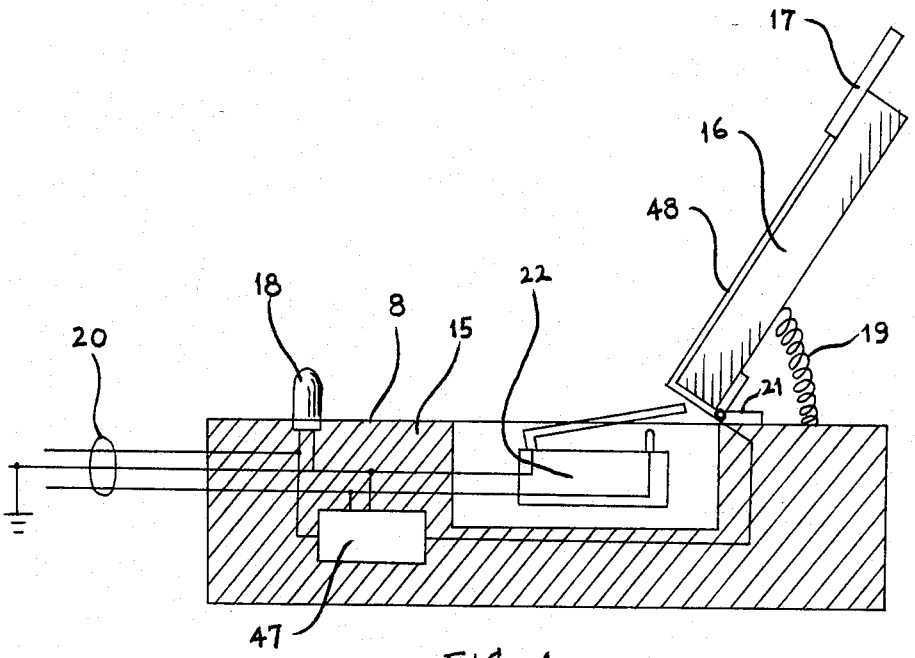
FIG. 4 is the side view of a target showing the open condition of the reset switch on the target which may be used with training apparatus shown in FIG. 1.
Figure 5:
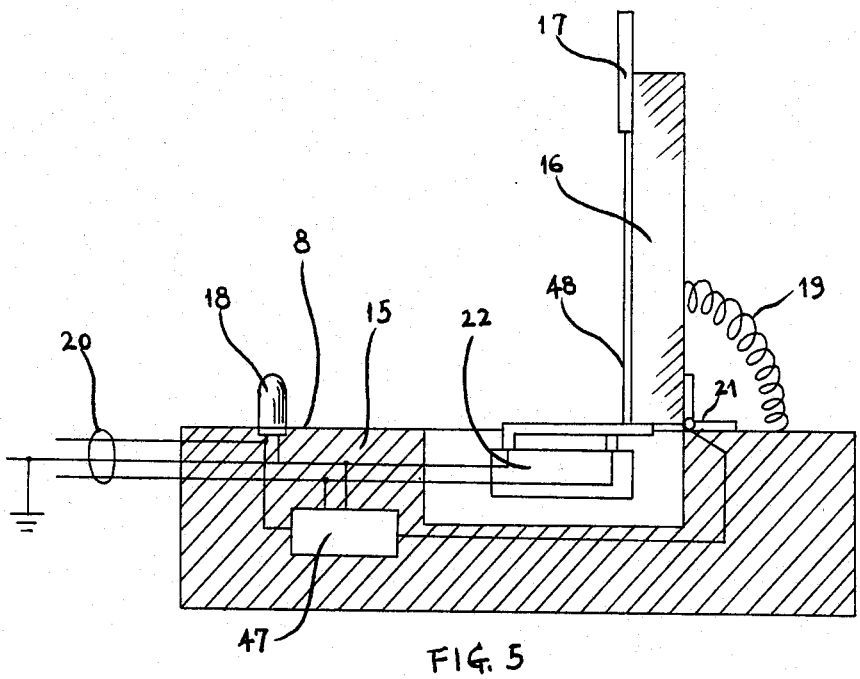
FIG. 5 is the side view of a target showing the close condition of the reset switch on the target which may be used with training apparatus shown in FIG. 1.

The elapsed time indicated on the time display 11 is a measurement of the performance of the player. It can be recorded in a record book with date and time for future reference. Aside from training the atheletes in improving the skills of reflex, speed and accuracy, the training apparatus can also be used in tournament competition for amusement purpose. Multiple players can compete in the tournament and play with the training apparatus as described before. Each player must finish certain compulsory plays within a fixed time and the player with the shortest elapsed time wins the competition. FIG. 4 and FIG. 5 show the open and close conditions of the reset switch 22 on target 8 respectively. As shown in FIG. 5, the reset switch 22 is initially pressed to the close condition by the weight of supporting arm 16 which is standing straight on the target base 15 and its bottom part is pressed on the contact arm of the reset switch 22. The closed contact of reset switch 22 shorts the middle and bottom wires of the signal cable 20. Since the middle wire of signal cable 20 is grounded at the other end that connects to the electronic device 10, the closed contact of reset switch 22 sends a ground signal to the electronic device 10 through the bottom wire of signal cable 20 to indicate the non-reset condition. As shown in FIG. 4, when the target ring 17 is hit by the player, the supporting arm 16 is tilted and its bottom part is not in contact with the contact arm of reset switch 22. The spring inside the reset switch 22 forces the contact arm open which in turn opens the connection between the middle and bottom wires of the signal cable 20. Because the bottom wire of signal cable 20 is pulled up to the power source by a resistor in the electronic device 10, this open contact condition sends a TRUE reset signal to the electronic device 10 through the bottom wire of signal cable 20 to reset the selection of target 8.

Figure 6:
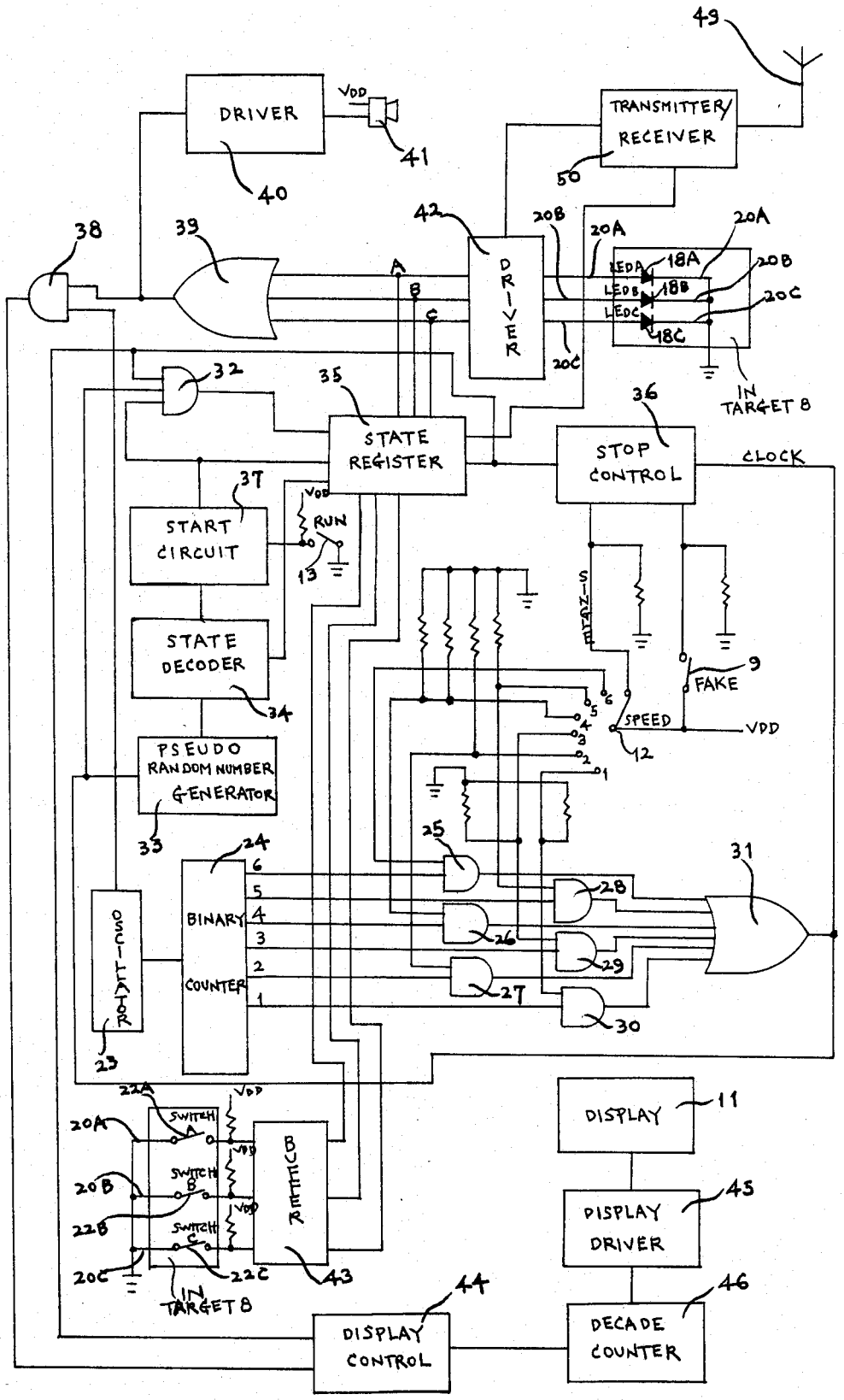
FIG. 6 is a schematic diagram of electronic circuitry suitable for implementing the training apparatus of FIG. 1.

An optional feature of using radio communication can be used to replace the signal cable 20 to communicate between the target 8 and electronic device 10. An antenna 48 can be installed on the supporting arm 16 and a transmitter/receiver 47 can be installed inside the target base 15. When power is supplied to the transmitter/receiver 47, it starts listening to the electronic device 10. When it receives a radio signal with certain frequency assigned to the target 8 as target selection signal, it immediately turns on the light emitting diode 18. When the player hits the target ring 17 of target 8, the supporting arm 16 is tilted and its bottom part is not in contact with the contact arm of reset switch 22 and reset switch 22 is open. This open switch condition activates the transmitter/receiver 47 to send a reset signal through the antenna 48 to electronic device 10. FIG. 6 is a schematic diagram of electronic control elements inside the electronic device 10. When power is applied to the electronic device 10, oscillator 23 starts running immediately. It generates a source clock at high frequency and feeds directly to binary counter 24. The binary counter 24 counts down the source clock to generate six clocks with lower frequencies; the clock at output 1 of binary counter 24 has the frequency one fourth as that of the source clock. Following the binary decreasing order, the clocks at outputs 3, 4, 5 and 6 of binary counter 24 have the frequencies ⅛, 1/16, 1/32 and 1/64 as that of the source clock respectively. These clocks are selected by speed selection switch 12 to control the target selection speed. When the speed selection switch 12 is in position 1, power source VDD is propagated through the contact of the speed selection switch 12 to the input of AND gate 30 to enable the clock generated by output 1 of the binary counter 24.

At the same time, positions 2, 3, 4, 5 and 6 of the speed selection switch 12 are open and the pull down resistors connected to these positions send ground signals to the inputs of AND gates 25, 26, 27, 28 and 29 to disable the clocks generated by outputs 2, 3, 4, 5 and 6 of the binary counter 24. In this situation, only output 1 of binary counter 24 passed through AND gate 30 to reach OR gate 31. OR gate 31 then distributes the selected clock to stop control 36, AND gates 32 and 38 and pseudo random number generator 33 to control the operation of the electronic device 10. When the speed selection switch 12 is in positions 2, 3, 4, 5 and 6, outputs 2, 3, 4, 5 and 6 of binary counter 24 are selected respectively in the same manner as that of switch position 1.

Random selection of targets 8A, 8B and 8C is controlled by pseudo random number generator 33, state decoder 34 and state register 35. There are many ways to generate pseudo random numbers. One way to implement the pseudo random number generator 33 is to use a 3-stage shift register and feedback the outputs from stage 2 and stage 3 to the input of stage 1 through an EXCLUSIVE OR gate. On the leading edge of each clock, old pseudo random number is changed to a new one and the sequence repeats after a fixed cycle. In this arrangement, the pseudo random number generator 33 generates a pseudo random number sequence of 1, 4, 2, 5, 6, 7, 3, 1, 4, 2, 5, 6, 7, 3, 1 . . . . In this sequence there are 7 different numbers, 1 to 7, repeat indefinitely. If each number represents one target, it can be used to select 7 different targets. Since there are only 3 targets in the training apparatus, 7 numbers must be combined into 3 states to randomly select these 3 targets. State decoder 34 uses the combinational logic to combine 1 and 5 into state A, 3, 4 and 6 into state B and 2 and 7 into state C. At each clock interval, only one state is high and the rest two states are low. The pseudo random states A, B and C from state decoder 34 are finally stored in state register 35 to randomly select the targets 8A, 8B and 8C, one at each clock interval. When the RUN switch 13 is turned on, start circuit 37 is activated. It provides a time delay to allow the player reach the waiting position, preferably in the middle of the target spreading that has equal distance from each target, before the first target is selected.

After a fixed time delay, start circuit 37 sends an enable signal (high signal) to AND gate 32. At this moment, the bottom input of AND gate 32 which is connected to stop control 36 is high. As a result, clock from OR gate 31 which is connected to the middle input of AND gate 32 is enabled by AND gate 32 and is sent to the state register 35 to store the pseudo random states A, B, C from state decoder 34. At each clock interval, only one state is high and the rest states are low. If state A is high first, the output A from state register 35 will send a high signal to driver 42 and OR gate 39. The driver 42 passes this high signal to target 8A through signal cable 20A and lights the light emitting diode 18A. At the same time, OR gate 39 sends this high signal from state A of state register 35 to driver 40 to turn on audio alarm 41 and also to AND gate 38 to enable the source clock from oscillator 23. This clock then sends to display control 44 to activate the decade counter 46. As long as state A of state register 35 stays high, decade counter 46 will continue the counting and the count in decade counter 46 is passed through display driver 45 to display the elapsed time in time display 11.

When the player closes the reset switch 22A by hitting the target ring 17A of target 8A, a reset signal (ground) is sent to buffer 43 through the signal cable 20A. This reset signal then sends to state register 35 to clear the state A of state register 35. When the state A of state register 35 is cleared, light emitting diode 18A and audio alarm 41 are disabled and the source clock from oscillator 23 to display control 44 is blocked by AND gate 38 thus stops the decade counter 46. Time display 11 displays the elapsed time from the selection of target 8A to the reset of target 8A. When the next clock from OR gate 31 reaches state register 35 through AND gate 32, next state, say state C, is set. State C of state register 35 then turns on light emitting diode 18C, audio alarm 41 and decade counter 46 in the same way as described in state A situation. When the player closes the reset switch 22C by hitting the target ring 17C of target 8C, a reset signal (ground) is sent to buffer 43 through the signal cable 20C. This reset signal then sends to state register 35 to clear the state C of state register 35. When the state C of state register 35 is cleared, light emitting diode 18C and audio alarm 41 are disabled and the source clock from oscillator 23 to display control 44 is blocked by AND gate 38 thus again stops the decade counter 46. When the next clock from OR gate 31 reaches state register 35 through AND gate 32, next state, say state B (can be state A again), is set. State B of state register 35 then turns on light emitting diode 18B, audio alarm 41 and decade counter 46 in the same way as described in state A situation. When the player closes the reset switch 22B by hitting the target ring 17B of target 8B, a reset signal is sent to state register 35 and disables the light emitting diode 18B, and alarm 41 and decade counter 46 in the same way as described in state A situation. Stop control 36 keeps track of set and reset conditions of target selection. At the third target reset, it sends out a stop signal to state register 35, AND gate 32 and display control 44 to prevent further action. The elapsed time displayed in time display 11 is the total time used by the player to respond to all target selections.

An optional transmitter/receiver 50 and antenna 49 can be used to replace signal cables 20A, 20B and 20C to communicate between electronic device 10 and targets 8A, 8B and 8C. Three different frequencies, frequency A, frequency B and frequency C, are assigned to target 8A, 8B and 8C respectively. When state A of state register 35 is set, the transmitter/receiver 50 sends out the target selection signal with frequency A through antenna 49. When this target selection signal with frequency A reaches target 8A, it turns on the light emitting diode 18. When the reset signal with frequency A is generated by transmitter/receiver 47 of target 8A and received by transmitter/receiver 50 through antenna 49, state A of state register 35 is cleared. The operations of selecting and reseting targets 8B and 8C are the same as that of target 8A.

Normal operation of stop control 36 can be modified by FAKE switch 9 and speed selection switch 12 in SINGLE position. When FAKE switch 9 is turned on, zero, one, or two fake target selections are placed before the true target selection. The fake target selection is operated in the same way as true target selection with the exceptions that the fake target selection is automatically cleared and decade counter 46 is disabled by the stop control 36. When the speed selection switch 12 is in SINGLE position, only one target selection is randomly activated. The second and the third target selections are disabled.

If the player wants to restart the operation, he can momentarily turn off the RUN switch 13 which in turn resets all the electronic circuits and then turn on the RUN switch 13 again. The rest operations are exactly the same as described before.

Figure 7:
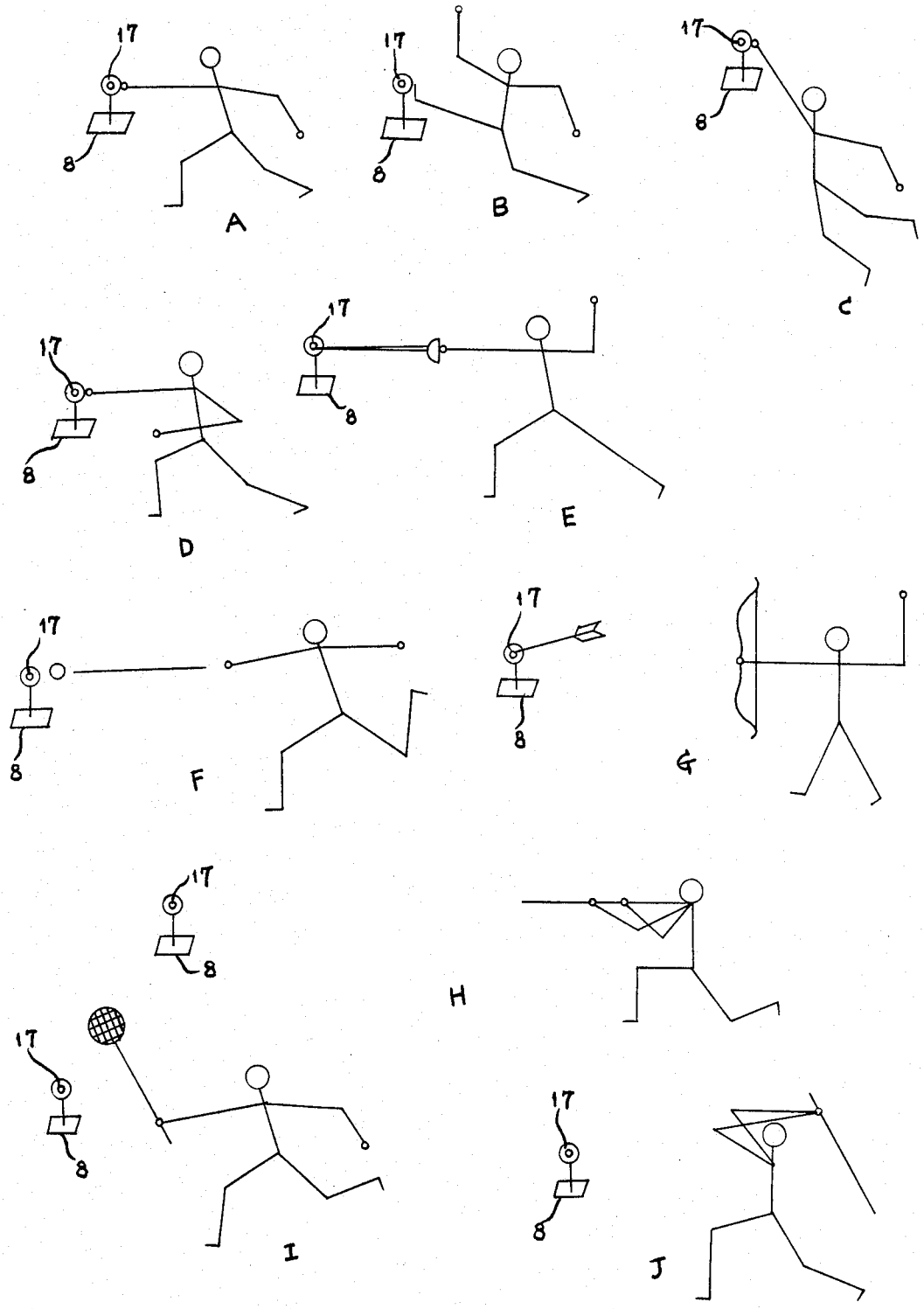
FIGS. 7A–J is a perspective view of some applications of a training apparatus used in different sports.

FIG. 7 shows some of the applications of the training apparatus used in different sports. In FIG. 7A, the player hits the target with his hand. It is used in training skills in basketball, volleyball, baseball, netball, football, korfball, handball, speedball, rugby, soccer and cricket. In FIG. 7B, the player kicks the target with his foot. It is used in training skills in speedball, football, rugby, soccer, judo, karate and aikido. In FIG. 7C, the target is placed at high location and the player jumps high to hit the target with his hand. It is used in training skills in basketball, football, baseball, volleyball, jai alai, netball, handball, rugby and soccer. In FIG. 7D, the player hits the target with his fist. It is used in training skills in boxing. In FIG. 7E, the player hits the target with a sword. It is used in training skills in fencing. In FIG. 7F, the player hits the target by throwing a ball at it. It is used in training skills in baseball, speedball, softball, cricket and rounders. In FIG. 7G, the player shoots the target with an arrow. It is used in training skills in archery. In FIG. 7H, the player shoots the target with a gun. It is used in training skills in shooting. In FIG. 71, the player hits the target with a racket. It is used in training skills in tennis, squash, racquetball, paddleball, badminton and table tennis. In FIG. 7J, the player hits the target with a bat. It is used in training skills in baseball, kendo, jai alai, softball, cricket, rounders, lacrosse, hockey, hurling, shinty, bandy and polo.

The foregoing detailed description has been given for clearness of understanding only and no unnecessary limitations should be understood therefrom. Many modifications and variations will be obvious to those skilled in the art. Thus it is to be understood that, within the scope of the appended claims, the invention may be practiced otherwise than as specifically described above.

What is claimed is:

1. A training apparatus comprising in combination multiple targets which are to be placed around the player with different distances and heights; an electronic device having electronic components for controlling the operation of said training apparatus; means for randomly selecting said targets; sound generator means acting as a coordinating means to coordinate the hearing, vision and body control of the player, responsive to said target selection means to automatically create a sound as said targets are selected by said target selection means; indicating means responsive to said target selection means for indicating when said targets are selected by said target selections; means for resetting said target selections; means for measuring elapsed time between said target selections and said target resettings; indicating means for indicating elapsed time measured by said measuring means; selection means for designating selection speeds of said target selections; means for selecting fake mode of said target selections in which true target selection is preceded by fake target selections for improving the judgment and coordination abilities of the player; means for communication between said electronic device and said targets whereby said targets can be placed at different distances and heights from the player, wherein means for supporting said target means and controlling means for generating reset signal is a rod with its top being connected to said target means and its bottom being hinged to said base means and positioned right on top of said means for generating reset signal whereby when said rod is in straight position, said means for generating reset signal is closed by the weight of said rod and when said rod is in tilted position due to the hitting of said target means by the player, said means for generating reset signal is open, thus generating a reset signal.

2. A training apparatus comprising in combination multiple targets which are to be placed around the player; an electronic device having electronic components for controlling the operation of said training apparatus; means for randomly selecting said targets; sound generator means responsive to said target selection means to automatically create a sound as said targets are selected by said target selection means; indicating means responsive to said target selection means for indicating when said targets are selected by said target selections; means for resetting said target selections;

means for measuring elapsed time between said target selections and said target resettings; indicating means for indicating elapsed time measured by said measuring means; selection means for designating selection speeds of said target selections; means for selecting fake mode of said target selections in which true target selection is preceded by fake target selections; means for communication between said electronic device and said targets; an oscillator; a binary counter which generates multiple clocks with different frequencies by counting down the clock generated by said oscillator; logic gates responsive to said selection means for designating selection speeds of said target selections to select one clock with desired frequency from said binary counter; a pseudo random number generator; a state decoder which converts the signals generated from said pseudo random number generator into multiple pseudo random states in which only one state is true at one clock period and each state represents one said target; a state register which stores the multiple pseudo random states from said state decoder and randomly selects one of said targets with one of the true state at each clock period, the true state in said state register being cleared by reset signal generated by said means for generating reset signal in said selected target; a display which displays the elapsed time measured in said decade counter; a sound generator responsive to said target selection means to automatically create a sound as said targets are selected by said target selection means and to stop the sound as said targets are reset by said means for generating reset signal in said selected targets; and a transmitter/receiver to communicate between said electronic device and said targets.

* * * * *